United States Patent [19]

Fairbairn

[11] 4,182,000

[45] Jan. 8, 1980

[54] SCRAPER ATTACHMENT FOR OSCILLATING VIBRATOR SANDERS

[76] Inventor: Hugh E. Fairbairn, 1422 Summit Ave., Cloquet, Minn. 55720

[21] Appl. No.: 963,957

[22] Filed: Nov. 27, 1978

[51] Int. Cl.[2] ..... A47L 13/08

[52] U.S. Cl. ..... 15/236 B; 15/93 R; 30/169; 173/29; 299/37

[58] Field of Search ..... 15/22 R, 22 A, 93 R, 15/236 R, 236 B; 30/169; 299/37; 173/29, 46; 29/76 A

[56] References Cited

U.S. PATENT DOCUMENTS

| | | | |
|---|---|---|---|
| 2,951,286 | 9/1960 | Mann | 30/169 |
| 3,395,414 | 8/1968 | Malin | 15/93 R |
| 3,468,384 | 9/1969 | Bodine | 173/49 |
| 3,604,520 | 9/1971 | Shatto, Jr. | 15/93 R X |
| 3,733,637 | 5/1973 | Becker | 15/93 R |
| 3,811,160 | 5/1974 | MacDonald | 30/169 X |
| 3,972,088 | 8/1976 | Thomas | 15/93 R X |
| 4,009,980 | 3/1977 | Alinder et al. | 299/37 |

*Primary Examiner*—Edward L. Roberts

*Attorney, Agent, or Firm*—Kinney, Lange, Westman and Fairbairn

[57] ABSTRACT

A scraper attachment for use with a hand-held power sander of the oscillating vibrator type is useful for scraping paint, and for removing various types of floor coverings rubber-back glued carpet, soft or cushion-type vinyl floor coverings, ceramic tile, Formica-type surfaces, and wallpaper. The scraper attachment includes a metal plate which is removably connected to the power driven platen of the hand-held power sander so that a blade portion of the metal plate projects forward of the front of the platen. The metal plate, when connected to the platen, is power driven by the platen, to provide a power scraper action.

23 Claims, 4 Drawing Figures

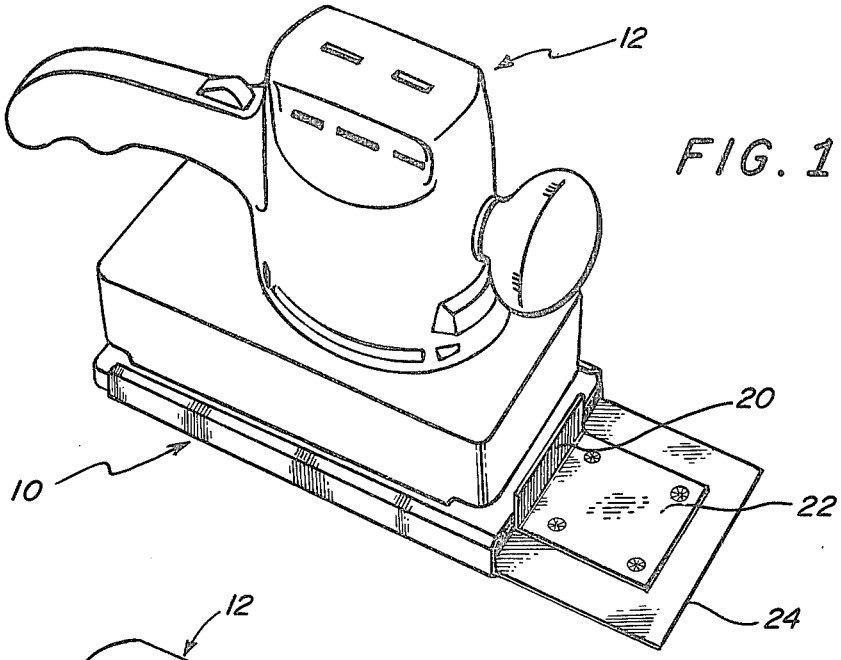
FIG. 1
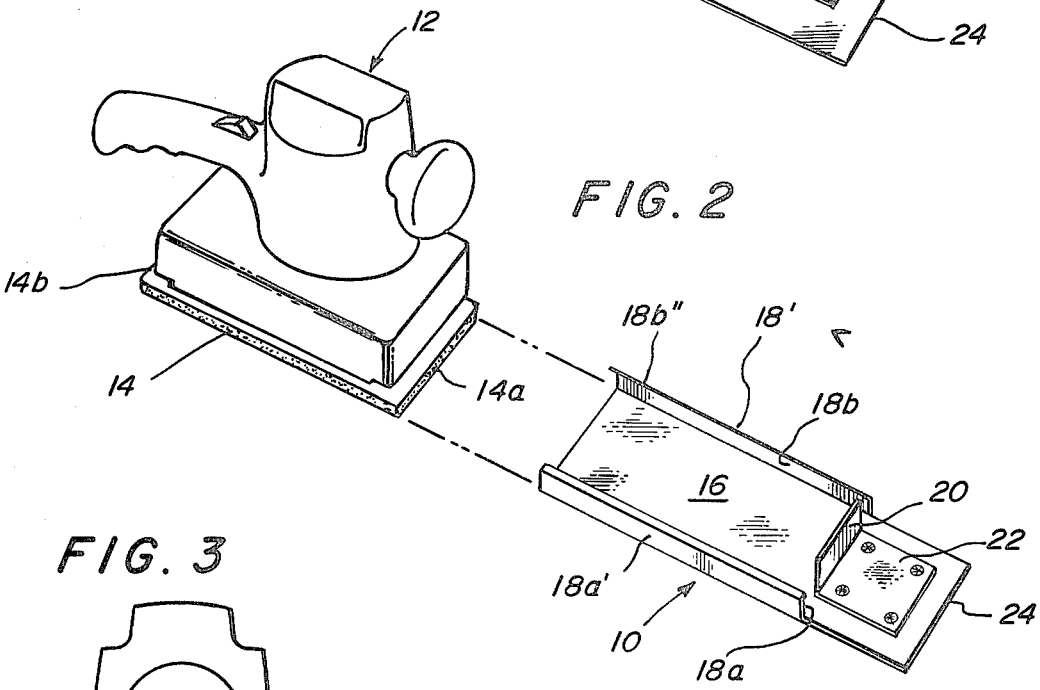
FIG. 2
FIG. 3
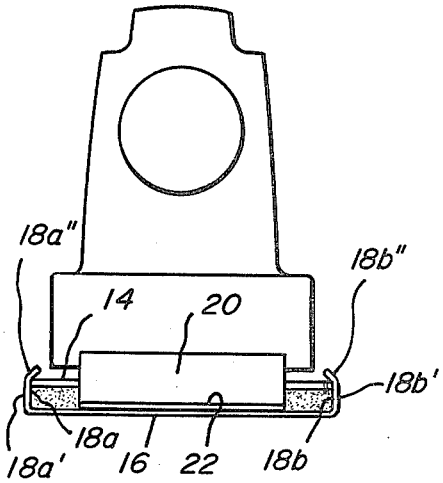
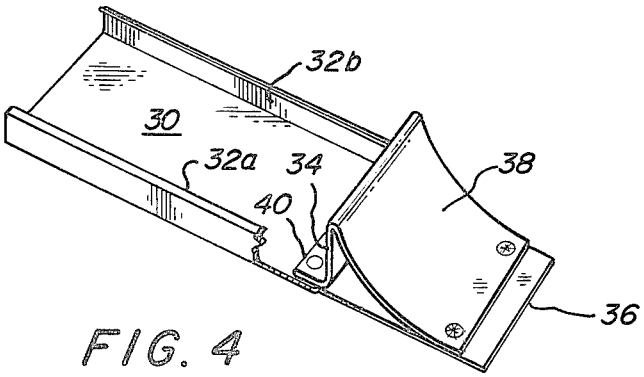
FIG. 4

SCRAPER ATTACHMENT FOR OSCILLATING VIBRATOR SANDERS

BACKGROUND OF THE INVENTION

1. Field of the Invention

The present invention is directed to power tools. In particular, the present invention is related to tools for scraping and stripping floor coverings, wall coverings, paint and other substances from various surfaces.

2. Description of the Prior Art

There is a well-established need for power driven scraper and stripper devices. For example, in the floor covering field, carpet and tile strippers have been developed which remove ceramic tile, glued-down carpet and carpet pads, and other substances on a floor surface in order to prepare the floor of the laying of a new carpet or other floor covering. U.S. Pat. Nos. 3,733,637 by Becker and 4,009,980 by Alinder et al describe special purpose devices which have been used for scraping a floor to remove tile or carpet. These devices are rather large, expensive, and specialized. While they are useful for professional carpet and tile installers, they are of little use to the handyman due to their specialized nature, size and cost.

U.S. Pat. No. 3,972,088 by Thomas describes an electric floor scrubber and buffer which also has a scraper member which may be used to scrape up gum or other substances stuck to the floor surface. Once again, the specialized nature, size, and cost does not justify use as a handyman's tool.

U.S. Pat. No. 3,395,414 by Malin, 3,468,384 by Bodine, and 3,604,520 by Shatto, Jr. describe hand-held scraper devices. In the Malin patent, the scraper device is a special attachment to a portable electric drill. The scraper device converts the rotary drive of the electric drill to a reciprocating motion driving a scraper.

The Bodine and Shatto patents are both special purpose scraper devices. The cost of special purpose scraper devices such as shown in these patents is not always justified by the extent of use which is made by the average handyman in work around his home.

There is a continuing need for a scraper device which can be used both by the professional floor covering installer and also by the handyman. The device must be low cost, simple to use, and usable for removing floor coverings, scraping paint, and a wide variety of other scraping and stripping operation. The device must be hand-held in order to be usable on wall and ceiling surfaces as well as floor surfaces.

SUMMARY OF THE INVENTION

The present invention is an extremely simple, yet highly effective scraper attachment which meets the needs of both the professional and the handyman. The scraper attachment is used in conjunction with a hand-held vibrating power sander of the type which has a power-driven platen having first and second opposite ends and first and second opposite sides. The scraper attachment comprises a metal plate having top and bottom surfaces and a front end, and connecting means which removably connect the metal plate to the platen. The front portion of the metal plate projects forward of the first end of the platen to form a scraping or stripping blade portion when the metal plate is connected by the connecting means. In operation, the metal plate is power driven along with the platen to provide a power scraper or stripper action.

In the preferred embodiments of the present invention, the connecting means comprise first and second flange means on opposite sides of the metal plate which slidably receive the first and second opposite sides of the platen, respectively. Stop means engages the first end of the platen and is positioned rearward the front end of the metal blade. The first and second flange means and the stop means permit the metal plate to be removably connected to hand-held power sanders manufactured by a wide variety of different manufacturers. The device, therefore, can be used with nearly all hand-held power sanders of the vibrating or oscillating type.

BRIEF DESCRIPTION OF THE DRAWINGS

FIG. 1 is a perspective view showing the scraper attachment of the present invention connected to a typical hand-held power vibrating sander.

FIG. 2 is a perspective view showing the scraper attachment of the present invention separated from the hand-held power vibrating sander.

FIG. 3 is a front view of the scraper attachment connected to the sander.

FIG. 4 is a perspective view of another embodiment of the scraper attachment of the present invention.

DETAILED DESCRIPTION OF PREFERRED EMBODIMENTS

FIGS. 1–3 illustrate one preferred embodiment of scraper attachment 10 of the present invention, which is used in conjunction with a conventional oscillating vibrator sander 12. In FIG. 2, scraper attachment 10 and sander 12 are separated while in FIGS. 1 and 3 attachment 10 has been connected to platen 14 of sander 12.

Vibrating sander 12 is one of a variety of vibrating type power hand sanders which have a power driven platen 14. Sanders of this type are manufactured by a number of different companies, including Black & Decker, Skil, Wen, Porter Cable and Rockwell. There are two conventional sizes of sanders, one having a platen of approximately $3\frac{1}{2}\times7$ inches, and a larger sander having a platen of about $4\frac{1}{2}\times9\frac{1}{2}$ inches. Sandpaper clamps (not shown in FIGS. 1 and 2) are provided at opposite ends **14*a* and 14*b* of platen 14**. Best results have been achieved using these sanders which have the dual feature of both reciprocating and orbital action, and which operate at about 4,000 RPM as compared to 10,000 RPM.

In the conventional previous use of sander 12, sandpaper (not shown) is clamped at the top surface of platen 14 near front end **14*a*, extends over front end 14*a*, across the bottom surface of platen 14, over rear end 14*b*, and into the clamp at the top rear surface of platen 14. An electric motor (not shown) within sander 12 drives platen 14 backwards and forwards, or in a slight orbital manner in a plane parallel to the bottom surface of platen 14**.

The scraper attachment 10 of the present invention slides over and is connected to platen 14, as shown in FIG. 2. Scraper 10 includes a base plate 16 which is preferably longer than the length of platen 14, first and second flanges **18*a* and 18*b*, stop 20, and blade stiffening or support member 22**.

Flanges **18*a* and 18*b* slide over platen 14 and engage the side and top surfaces of platen 14. Stop 20 limits the sliding of scraper 10 onto platen 14** by engaging front surface 14*a* of platen 14. Flanges 18*a* and 18*b* and stop 20, therefore, form connecting means which removably and slidably connect scraper attachment 10 to sander 12.

As shown in FIGS. 1 and 2, plate 16 extends forward of stop 20 and has a front edge 24. It is front edge 24 which provides scraping or stripping action when scraper attachment 10 is installed on sander 12 and is power driven with platen 14.

Between stop 20 and front edge 24 is a blade support member 22 which is a flat plate attached to the top surface of plate 16. Blade support member 22 stiffens the blade portion of metal plate 16 which extends forward of stop 20. In the preferred embodiment shown in FIGS. 1 and 2, stop 20 and blade support member 22 are formed of a single metal plate, which is turned upward by essentially 90 degrees at its rear end to form stop 20. Blade support member 22 is preferably spot welded to the top surface of plate 16.

In the preferred embodiments, plate 16 and flange members 18*a* and 18*b* are also formed of a single sheet of metal. Flange 18*a* includes a side portion 18*a*′ which is generally perpendicular to plate 16 and a top portion 18*a*″ which extends inwardly from side portion 18*a*′. Similarly, flange 18*b* includes an upstanding side portion 18*b*′ and a top portion 18*b*″ which extends inwardly.

As stated previously, nearly all vibrating type sanders have one of two platen sizes. It is possible, therefore, with only two scraper attachment sizes, to accommodate virtually all oscillating vibrator sanders. For the smaller platen size of $3\frac{1}{2}$ inches×7 inches, the width of plate 16 is preferably $3\frac{5}{8}$ inches, the height of flange side portions 18*a*′ and 18*b*′ is about $\frac{5}{8}$ inches, and the width of flange top portions 18*a*″ and 18*b*″ is about 3/16 inches. The overall length of plate 16 is about 10 inches, and the distance from the front of flanges 18*a* and 18*b* to front edge 24 is about $3\frac{1}{2}$ inches. In this preferred embodiment, stop 20 and blade support 22 are a single plate of metal having dimensions of 3×4 inches. The plate is folded upward at 90 degrees to provide stop 20 of about 1 inch height and blade support 22 of 3×3 inches. Blade support 22 is attached with its front edge approximately $\frac{1}{2}$ inch from front edge 24 of plate 16.

For the large platen size of $4\frac{1}{2}$ inches×$9\frac{1}{2}$ inches, the width of plate 16 is $4\frac{5}{8}$ inches, and the length is $12\frac{1}{2}$ inches. The blade portion of plate 16 which extends beyond stop 20 is once again about $3\frac{1}{2}$ inches. The dimensions of flanges 18*a* and 18*b* are the same as with the smaller scraper attachment, except that they have a length of about 9 inches. Stop 20 and blade support 22 are a 4 inch×4 inch plate, with stop 20 being folded upward at 90 degrees to a height of about 1 inch.

In the preferred embodiments of the present invention, the scraper attachment 10 is at least about 18 gauge and less than about 14 gauge iron and may be cold roll, hot roll, galvannealed or galvanized iron. The advantage of galvanized or galvannealed iron is that no painting is required.

An important advantage of the scraper attachment of the present invention is that it can be manufactured at extremely low cost. The attachment can be made with conventional sheet metal working tools such as a squaring shear, notcher, bar folder, and spot welder. Plate 16 and flanges 18*a* and 18*b* are formed by blanking out the metal plate into a rectangular shape, forming two notches on opposite sides at the front end to define the blade portion of plate 16 which extends forward of flanges 18*a* and 18*b*. Two folds are required to produce each flange. Stop 20 and blade support 22 are also blanked out in rectangular shape, and then folded by 90 degrees to produce stop 20. Blade support 22 is then spot welded at each corner to the top surface of plate 16. No sharpening or other special treatment of front edge 24 is required.

Despite its simple construction and low cost, the scraper attachment of the present invention has proved to be extremely effective for a wide variety of scraping and stripping operations. For example it has been used successfully to remove glued-down rubber back carpeting, soft back type floor coverings, such as lineoleum and cushion-type vinyl floor coverings, and ceramic tile floor surfaces. In newly constructed homes, often the floor covering installer encounters sand mortar mix, joint compound and floorstone which have been dropped or deposited on the floor surfaces during construction. These materials must be removed prior to laying carpet or other floor covering. The scraper attachment of the present invention has successfully removed all of these hard materials from floor surfaces.

In addition to its use by the amateur and professional floor covering installer, the present invention has been extremely effective in removing other materials from surfaces. For example, it has successfully removed Formica-type surface coverings. It has also removed wallpaper from walls after the wallpaper has been steamed to loosen the wallpaper adhesive.

Another extremely advantageous use of the scraper attachmen of the present invention is scraping paint from the exterior siding of buildings. It is extremely important to scrape the old and cracked paint from siding prior to applying another coat of paint. This task, however, is extremely time-consuming and tedious, particularly if it is done by hand. The scraper attachment of the present invention provides a rapid and effective means of scraping paint from siding.

FIG. 4 shows another embodiment of the scraper attachment of the present invention, which is particularly useful in removing ceramic tile and Formica-type surface coverings. The scraper attachment of FIG. 4 includes a metal plate 30 and flanges 32*a* and 32*b*, which are generally similar to plate 16 and flanges 18*a* and 18*b* of the scraper of FIGS. 1 through 3C. In FIG. 4, plate 30 has a blade portion which extends a considerable distance in front of stop 34. In one preferred embodiment, front edge 36 of plate 30 is about 6 to 7 inches in front of stop 34. Connected between plate 30 and stop 34 is a generally curving metal deflector 38, which is attached to the top surface of plate 30 near front edge 36. In the preferred embodiment of the present invention shown in FIG. 4, stop 34, deflector 38, and attachment tab 40 are a unitary sheet of metal. Both deflector 38 and attachment tab 40 are spot welded to the top surface of plate 30.

The advantage of the scraper attachment of FIG. 4 is that it provides a general curving deflector surface which is particularly useful in peeling up ceramic tile or Formica-type coverings. This prevents cracking or chipping out of the materials which can occur when the shorter blade type scraper like that shown in FIGS. 1–3 is used. In addition, deflector 38 acts as a blade support or stiffening member, in a similar manner to blade support 22 of FIGS. 1–3.

Other embodiments of the present invention are also possible. For example, although most applications do not require a specially hardened scraping front edge, this can be provided by use of a high-quality steel or a metal plate. In this embodiment, the metal plate is a high-quality steel in the range of about SAE 1050. During the fabrication of the scraper attachment, a torch is run along the front edge of the blade portion, and the front edge is then immediately quenched. By raising the temperature of the steel to the tempering range and then quenching, the front edge of the blade portion is hardened. It has been found that most general applications of the scraper attachment of the present invention do not require special hardening of the front edge, but for certain scraping operations the hardened front edge may be valuable.

As discussed previously, the front edge of the blade portions generally is not sharpened. It is possible, however, to use heavier gauge metal for the plate and provide some sharpening of the front edge. The use of heavier gauge material may also eliminate the need for a blade support member. In addition, in some embodiments the front edge is notched, which provides some improvement in cutting in some applications.

In another embodiment of the present invention, a leather or flexible strap is attached to the back end of the metal plate. This flexible strap engages the sandpaper clamp at the back end of the sander platen. The flexible strap eliminates any chance of the scraper becoming disconnected from the sander during use. In most cases, however, the flexible strap has been found to be unnecessary, since the pressure between the stop and the front end of the platen during use is all that is required to keep the scraper attached to the platen.

The connecting means, which in the preferred embodiments shown in FIGS. 1–4 comprise first and second flanges and a stop, may take other forms than those specifically shown. For example, the flanges need not extend all the way from the stop to the rear end of the metal plate. The configuration shown in FIGS. 1–4, of course, leads to an extremely simplified fabrication process, since only one notching operation is required. It is not necessary, however, that flanges extend the entire length shown, provided they reliably receive and hold the platen.

In addition, other connecting means may be used to removably connect the scraper attachment to the platen. Various types of clamping or connecting means may be used, including the use of screws to attach the metal plate to the bottom surface of the platen. The preferred embodiments of the present invention shown in FIGS. 1–4, of course, have the advantage of providing easy sliding connection and disconnection of the attachment and the sander platen. This is particularly advantageous with a scraper attachment which is intended to be usable with a variety of different sanders produced by a variety of different manufacturers.

In conclusion, the scraper attachment of the present invention represents a significant advance over the prior art scrapers. First, it is an extremely low cost device. Second, it is extremely simple to fabricate. Third, it is small, portable and uses a minimum of material. Fourth, it is simple to use. Fifth, it is usable with nearly all conventional vibrating power sanders. Sixth, it is capable of scraping or stripping on floors, walls, ceilings, exterior siding, and other surfaces. Seventh, it is extremely effective for a wide variety of scraping and stripping purposes, including removal of glued-down rubber back carpet, lineoleum floors, cushion vinyl floors, ceramic tile, sand mortar mix, joint compound, floorstone, Formica-type coverings wallpaper, and paint.

Although the present invention has been described with reference to preferred embodiments, workers skilled in the art will recognize that changes may be made in form and detail without departing from the spirit and scope of the invention.

What is claimed is:

1. An attachment for use with a hand-held power sander of the type having a power driven platen having first and second opposite ends and first and second opposite sides, the attachment comprising:

a metal plate means having top and bottom surfaces and a front end; and connecting means for removably connecting the metal plate means to the platen with the front end of the metal plate means being positioned forward of the first end of the platen to form a blade portion which is power driven with the platen, wherein the connecting means comprises:

first and second flange means on opposite sides of the metal plate means for slidably receiving the first and second opposite sides of the platen, respectively, wherein each flange meas comprises a side portion projecting generally upward and connected along one side of the metal plate means and a top portion projecting generally inwardly from the side portion; and stop means for engaging the first end of the platen, the stop means being positioned rearward of the front end of the metal plate means.

2. The attachment of claim 1 and further comprising blade support means attached to the top surface of the metal plate means at a position between the stop means and the front end of the metal plate means.

3. The attachment of claim 2 wherein the stop means and the blade support means comprise a second metal plate having a first portion parallel to and attached to the metal plate means and a second portion projecting upward from the top surface of the metal plate means, the first portion of the second metal plate forming the blade support means and the second portion forming the stop means.

4. The attachment of claim 1 wherein the stop means is positioned proximate a forward end of each of the first and second flange means.

5. The attachment of claim 1 wherein the metal plate means and the first and second flange means comprise a unitary body.

6. The attachment of claim 5 wherein the metal plate means has a width of about $3\frac{5}{8}$ inches, and the side portions of the first and second flange means have a height of about $\frac{5}{8}$ inches.

7. The attachment of claim 6 wherein the top portions of the first and second flange means have a width of about 3/16 inches.

8. The attachment of claim 6 wherein the metal plate means has a length of about 10 inches.

9. The attachment of claim 8 wherein the stop means is positioned about $3\frac{1}{2}$ inches rearward of the front end of the metal plate means.

10. The attachment of claim 5 wherein the metal plate means has a width of about $4\frac{5}{8}$ inches, and the side portions of the first and second flange means have a height of about $\frac{5}{8}$ inches.

11. The attachment of claim 10 wherein the top portions of the first and second flange means have a width of about 3/16 inches.

12. The attachment of claim 10 wherein the metal plate means has a length of about $12\frac{1}{2}$ inches.

13. The attachment of claim 12 wherein the stop means is positioned about $3\frac{1}{2}$ inches rearward of the front end of the metal plate means.

14. The attachment of claim 1 wherein the metal plate means is sheet iron of between about 18 gauge and about 14 gauge.

15. The attachment of claim 1 and further comprising:

deflector means connected to the top surface of the metal plate means proximate the front end and extending rearwardly and upwardly.

16. The attachment of claim 1 wherein the deflector means is connected to the stop means.

17. The attachment of claim 16 wherein the deflector means and the stop means comprise a unitary body.

18. An attachment for removing material from a work surface, the attachment being for use with a hand-held vibrating-type power sander having a power driven platen having first and second opposite ends, first and second opposite sides, a bottom surface and a top surface, the attachment comprising:

a metal plate means having top and bottom surfaces, a platen engaging portion, and a blade portion having a front edge; and connecting means for removably connecting the platen engaging portion of the metal plate to the platen with the top surface of the platen engaging portion of the metal plate means proximate the bottom surface of the platen, and the blade portion of the metal plate means projecting forward of the first end of the platen and being generally parallel to the platen, whereby the blade portion is power driven with the platen, said connecting means being positioned above a plane defined by the bottom surface of the blade portion thereby permitting the blade portion to be oriented essentially parallel to the work surface when power driven.

19. The attachment of claim 18 wherein the connecting means slidably connects the metal plate means to the platen.

20. The attachment of claim 19 wherein the connecting means comprises:

first and second flange means on opposite sides of the metal plate means for slidably receiving the platen, respectively.

21. The attachment of claim 20 wherein the metal plate means and first and second flange means comprise a unitary body wherein each flange means comprises a side portion projecting generally upward and connected along one side of the metal plate means and a top portion projecting generally inwardly from the side portion.

22. The attachment of claim 18 wherein the connecting means further comprises:

stop means for engaging the first end of the platen, the stop means being positioned rearward of the front edge.

23. The attachment of claim 22 and further comprising blade support means attached to the top surface of the metal plate means at a position between the stop means and the front edge of the metal plate means.

* * * * *